United States Patent [19]

Bingaman

[11] 3,999,261

[45] Dec. 28, 1976

[54] PAD-TYPE JAR GRIPPER

[76] Inventor: Harold J. Bingaman, 6309 Pentz-Magalia Highway, Paradise, Calif. 95969

[22] Filed: Dec. 8, 1975

[21] Appl. No.: 638,893

[52] U.S. Cl. ..... 269/217; 24/255 BS; 269/289 R

[51] Int. Cl.[2] ..... A41B 21/00

[58] Field of Search ..... 24/10 A, 10 R, 73 VA, 24/255 BS, 10; 211/74; 215/100, 100.5

[56] References Cited

UNITED STATES PATENTS

| | | | |
|---|---|---|---|
| 2,051,068 | 8/1936 | Ayre et al. | 24/255 BS UX |
| 2,264,489 | 12/1941 | Tiegler et al. | 215/100 R UX |
| 2,956,687 | 10/1960 | Robichaud | 215/100 R UX |
| 2,963,256 | 12/1960 | Borah | 215/100 R UX |

FOREIGN PATENTS OR APPLICATIONS

| | | | |
|---|---|---|---|
| 497,987 | 12/1953 | Canada | 24/255 BS |
| 530,885 | 10/1921 | France | 215/100.5 |
| 781,338 | 8/1957 | United Kingdom | 215/100.5 |

*Primary Examiner*—Donald A. Griffin

[57] ABSTRACT

A pad-type jar gripper with a circular depression in the center for holding the base of a conventional canning jar securely during hot-jar processing, the gripper automatically adjusting for tighter holding when a jar is pressed downward in the pad depression and readily releasing the jar when it is lifted from the pad.

As illustrated in the drawings and described in more detail hereinafter, the particular embodiment of this invention comprises a base pad having firm but pliable stubby gripper fingers angled upward from the outer edge of the pad. These fingers are so arranged around the circumference of a circular depression in the pad as to accept the bottom section of a conventional canning jar. The fingers extend up the jar sides sufficiently to prevent the jar from being easily tipped. The bottom part of the pad has a soft center directly beneath the bed of the jar-holding depression. The shape of the pad where the soft material is impressed plus the give of the soft material allows weight or downward pressure applied on the held jar to angle the gripper fingers inward. This activates the gripper fingers causing them to close tightly around the base of the jar. The jar then is gripped securely from below while the jar lid is being tightened with a downward pressure being applied from above. This downward pressure also activates suction indentations underneath the pad to prevent the pad from slipping. This gripper device is also self-adjusting to easily release a jar when weight or pressure is reduced as the jar is lifted from the gripper fingers.

6 Claims, 7 Drawing Figures

PAD-TYPE JAR GRIPPER

The present invention relates to devices for gripping conventional canning jars firmly as a holding base while filling the jar or tightening the lid and is particularly directed towards use during hot jar processing to eliminate the need of direct contact with a hot canning jar by the canner's hands.

Presently used methods for holding the bottom of a hot canning jar range anywhere from using grotesque holders which must be squeezed to picking the hot jar up by hand protected only by a cloth or a clumsy mitten. Anyone having watched wife, mother, grandmother, or others with canning expertise struggle valiantly with both ends of a wet towel to hold and tighten the lid on a steaming canning jar can well appreciate the need for a better way. Good devices for hands-off management of hot jars are quite scarce in the market place today. Even the few rubber pads available to the canning housewife are actually designed for a different use and offer little in the way of spill protection other than preventing counter tops from getting wet. Ordinary hot pads which are often used as hot jar holders add nothing advantageous to the line of equipment for this use. And a close examination of presently offered devices for holding these hot jars easily indicates why most of today's canners still prefer the dish towel or hot pad as the dominate means for holding a hot canning jar while tightening the twist band on a sterilized lid.

The present invention is designed to overcome limitations in the field of hot canning jar holding devices and to supply an obviously needed piece of equipment for the home canner.

Accordingly, the pad-type jar gripper illustrated in the drawings and described herein is designed to be set flat on a counter top or table top and to hold hot canning jars in a manner that prevents them from being easily tipped over. The device is also self-activating having stubby fingers which will grip the jar tighter as the jar is filled. When cooked food is poured into the sterilized jar, the tightening of the fingers makes accidental spillage from the jar still more difficult. During the tightening of screw bands or caps to seal up the jars, the automatic gripper feature of the present invention is most important. The pad-type jar gripper will securely hold the jar in a stable and firm position while the cap is being screwed down. Used in conjunction with other holders or cap tightening devices, the present invention with automatic holding action completely eliminates the need for a hot pad or a holding towel or the operator's hand on the hot jar.

Therefore, the primary object of the present invention is to provide a base holder for hot canning jars which is pad-like having a centered depression surrounded by gripper fingers and manufactured in units sized for various conventional canning jars and designed to automatically adjust to hold a jar firmly when the proper size jar is placed in the holding depression.

A further object of the invention is to provide a pad-type jar gripper having a means for self-activating gripper fingers around a jar holding depression which will tighten on a held jar as weight is added to further secure the jar during the canning process so that spillage from a jar being filled or a full jar becomes more difficult.

A still further object of the pad-type jar gripper is to provide a means for holding the base of a canning jar which will grip the jar securely when downward pressure is applied to assist the canner in the tightening of screw bands or caps.

Another object of the present invention is to provide the home canner with a jar base holding device which is pad-like and having a means in the underside for permanently or temporarily adhereing to a counter top or a table top or other surface so that the pad will not tend to slip or turn during use.

A still further object of the pad-type jar gripper described herein is an easy release mechanism wherein gripper fingers which automatically adjust to hold a properly sized and placed conventional canning jar securely will self-adjust to an open position as weight is reduced and will release the held jar easily when the jar is lifted from the gripper fingers.

Additional objects and many advantages of this invention will become apparent with the reading of the following specification and referring to the accompanying drawings wherein corresponding parts in each of the several views are represented by similar characters of reference.

Figure 1:
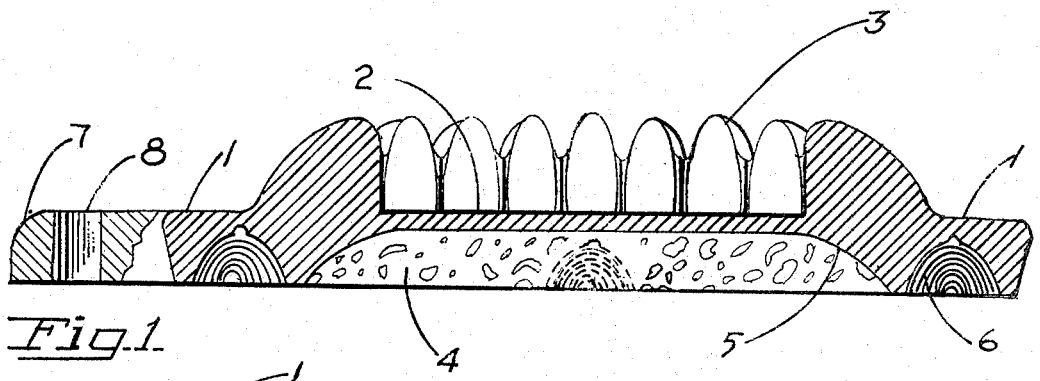
FIG. 1 is a sectional view of the invention showing a side elevation opened to disclose the structure of the pad with internal working sections exposed.
Figure 2:
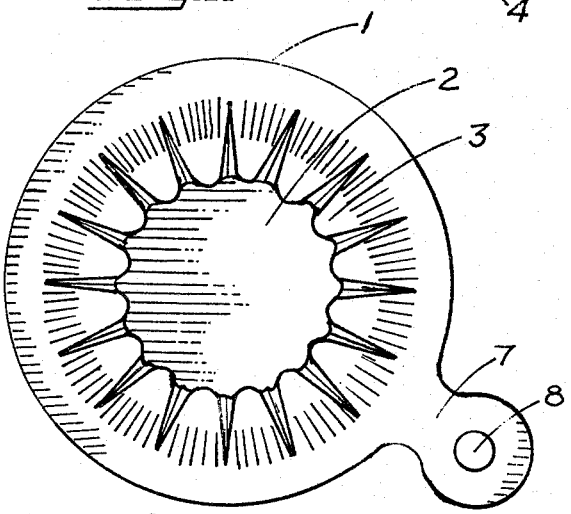
FIG. 2 is a top perspective view of the pad-type jar gripper showing the circular jar-holder depression and the arrangement of the gripper fingers.
Figure 5:
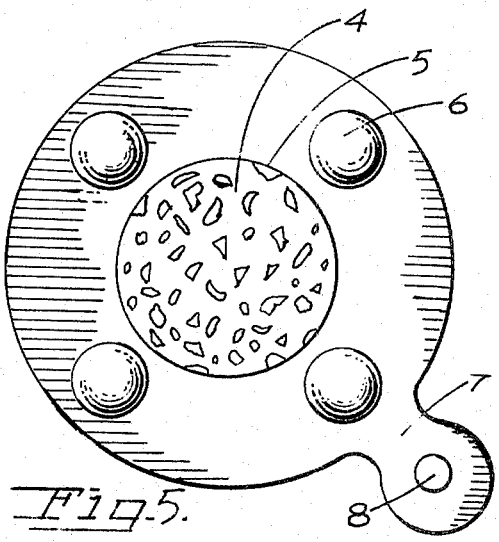
FIG. 5 is a pictorial view of the bottom of the pad showing the pliable center section and the location of the vacuum cup indentations.
Figure 3:
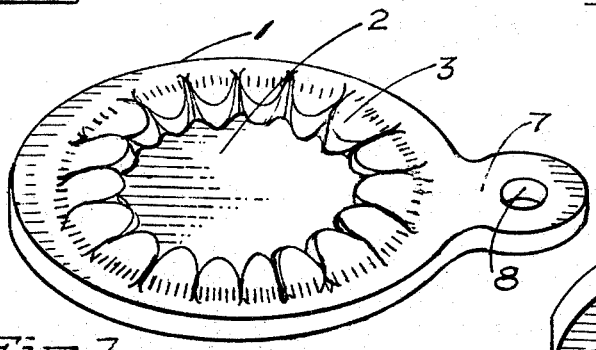
FIG. 3 is a pictorial view showing the upper surface of the pad angled so the separation of the gripper fingers can be seen.
Figure 6:
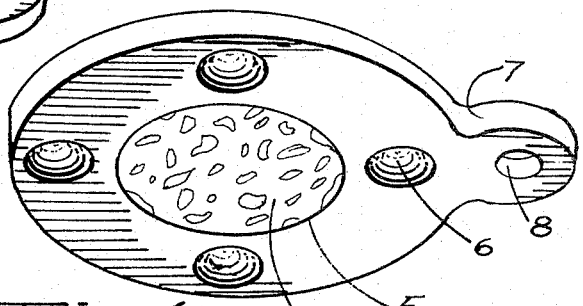
FIG. 6 is a pictorial view of the pad-type jar gripper angled to show the underside.
Figure 4:
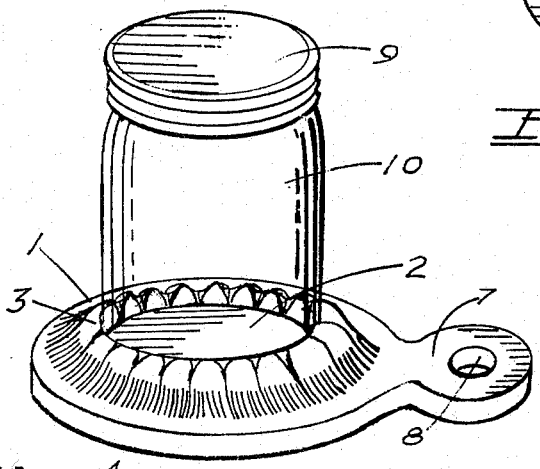
FIG. 4 is a pictorial view similar to FIG. 3 with a conventional glass canning jar positioned in the holder.
Figure 7:
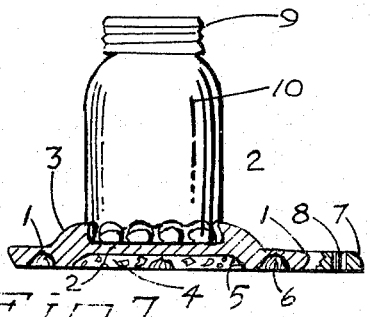
FIG. 7 is a sectional view of the pad-type jar gripper with a conventional glass canning jar in the holder depression showing the fingers pressing the sides of the jar.

Referring to the drawings, the pad-type jar gripper which characterizes the present invention comprises the curved sectional body of the pad 1 at the top center of which is circular depression bed 2, and affixed to the surface of pad 1 around the circumference of depression bed 2 are spaced the stubby, pliable gripper fingers 3. Directly beneath depression bed 2 is pliable material 4 housed in the underbody of pad 1 in receptacle 5. Receptacle 5 has curved walls and is flat at the top where this chamber runs parallel to depression bed 2 and at the base adjoins the four cross-located vacuum domes 6 cut in the bottom of pad 1. One end of pad 1 is so formed as to make the upper circle of a figure eight, this upper circle being handle 7 through the center of which is aperture 8, handle 7 and aperture 8 being for wall-hanging storage of the unit.

When in use, pad 1 is placed flat on a working surface with the underbody containing pliable material 4, receptacle 5, and vacuum domes 6 facing downward against the working surface. Depression bed 2 with spaced gripper fingers 3 around the circumference faces upward to receive the conventional canning jar 10 for which depression bed 2 has been properly sized. In this position, glass canning jar 10 is supported sufficiently by gripper fingers 3 to prevent its easy tipping.

As glass canning jar 10 is filled with ingredients being processed, the added weight causes pliable material 4 to compress dropping depression bed 2 which applies pressure to the curved walls of receptacle 5. This pressure on receptacle 5 forces gripper fingers 3 to angle in and tighten about conventional glass canning jar 10. As more weight or more downward pressure is applied to jar 10, the tighter gripper fingers 3 will hold jar 10. The gripping action greatly assists the canner to hold jar 10 when tightening cap 9. And pressing down to tighten the cap activates vacuum domes 6 which help pad 1 from slipping or turning during the tightening of cap 9. Resilience in the material used in pad 1, gripper fingers 3, and pliable material 4 in combination is structured to return gripper fingers 3 to an open position when filled jar 10 is lifted from the pad-type jar gripper. The resilience reaction facilitates an easy release mechanism for removal of the glass canning jar 10 from this device.

Although my invention has been described in considerable detail for clarity of understanding by referring to illustration and example, it is understood that some changes and modifications may be exercised which keep within the spirit of the invention and scope of the appended claims.

I claim:

1. A pad-type jar gripper, comprising a device designed as a stabilizing base holder for conventional canning jars wherein a pad-like structure having a circular depression centered in the upper surface has this surface appended with interfacial gripper fingers which conjoin with the walls of and are spaced around the circumference of the circular depression, this arrangement constituting a base holder for conventional canning jars with said holder being sized in different units of the device to accept the bottom section of various types of canning jars; and the holders of each unit designed to grip a properly placed canning jar of the correct capacity for that particular unit of the device in a secure manner, the gripper fingers becoming tighter around the base of the canning jar as weight or pressure is applied in the vicinity of the depression bed in which the jar is being held, said device being self-adjusting to release a held canning jar when weight or pressure on the holder depression bed is reduced.

2. A pad-type jar gripper as defined in claim 1, wherein the underside of the pad is provided with a means to adhere the gripper pad to a work surface that means being suction, adhesives, and hardware where applicable.

3. A pad-type jar gripper as defined in claim 1, wherein said pad-type jar gripper is manufactured as a part and a function of other machinery, the gripper unit being a single function, used in multiple units, and in combinations of unit sizes as needed.

4. A pad-type jar gripper as defined in claim 1, wherein a means is provided to mechanically activate the gripper fingers.

5. A pad-type jar gripper as defined in claim 1, wherein the means for supporting the canning jar holder bed is a pliable material in a dome shaped chamber in the lower section of said pad being directly below the holder depression bed.

6. A pad-type jar gripper as defined in claim 1, wherein the action of the gripper fingers is dependent upon the structure of the pad and the pliance and the resilience in the materials of manufacture and having the chamber below the holder depression bed filled with a spongy material.

* * * * *